US010210799B2

(12) United States Patent
Mao

(10) Patent No.: US 10,210,799 B2
(45) Date of Patent: Feb. 19, 2019

(54) PIXEL COMPENSATION CIRCUIT AND DISPLAY DEVICE

(71) Applicant: Wuhan China Star Optoelectronics Semiconductor Display Technlology Co., LTd., Wuhan, Hubei (CN)

(72) Inventor: Peng Mao, Guangdong (CN)

(73) Assignee: Wuhan China Star Optoelectronics Semiconductor Display Technology Co., Ltd., Wuhan, Hubei (CN)

( * ) Notice: Subject to any disclaimer, the term of this patent is extended or adjusted under 35 U.S.C. 154(b) by 0 days.

(21) Appl. No.: 15/554,219

(22) PCT Filed: Jul. 21, 2017

(86) PCT No.: PCT/CN2017/093820

§ 371 (c)(1),
(2) Date: Aug. 29, 2017

(65) Prior Publication Data

US 2019/0005873 A1 Jan. 3, 2019

(51) Int. Cl.
*G09G 3/30* (2006.01)
*G09G 3/3225* (2016.01)

(52) U.S. Cl.
CPC ... *G09G 3/3225* (2013.01); *G09G 2300/0819* (2013.01); *G09G 2320/0233* (2013.01); *G09G 2320/045* (2013.01)

(58) Field of Classification Search
CPC ..... G09G 3/30; G09G 3/3208; G09G 3/325; G09G 3/3241; G09G 3/3225; G09G 3/3233; G09G 3/3258
See application file for complete search history.

(56) References Cited

U.S. PATENT DOCUMENTS

2009/0219232 A1* 9/2009 Choi ..... G09G 3/3233 345/76
2014/0312784 A1 10/2014 Yin et al.
2016/0155385 A1* 6/2016 Yang ..... G09G 3/3233 345/174

(Continued)

FOREIGN PATENT DOCUMENTS

CN 105259700 A 1/2016
CN 105404047 A 3/2016

(Continued)

*Primary Examiner* — Roy P Rabindranath
(74) *Attorney, Agent, or Firm* — Andrew C. Cheng

(57) ABSTRACT

The invention provides a pixel compensation circuit and a display device. Control terminals of first and second switches connects first and second light-emitting control terminals, first terminals of the first and second switches are connected; a control terminal of a third switch receives a first signal, a first terminal connects a second terminal of the first switch, a second terminal connects a first terminal of a driving switch; an anode of a diode connects a second terminal of the driving switch, a cathode connects a second voltage terminal; a control terminal and a first terminal of a fourth switch receive second and third signals, a second terminal connects a control terminal of the driving switch; a first capacitor connects the control terminal of the driving switch and a second terminal of the second switch, a second capacitor connects the second terminals of the first and second switches.

7 Claims, 5 Drawing Sheets

(56) References Cited

U.S. PATENT DOCUMENTS

| | | | | |
|---|---|---|---|---|
| 2016/0253963 | A1* | 9/2016 | Yang | G09G 3/3225 345/211 |
| 2016/0379552 | A1 | 12/2016 | Kim et al. | |
| 2017/0061876 | A1 | 3/2017 | Cho et al. | |
| 2017/0116918 | A1 | 4/2017 | Dong et al. | |
| 2017/0146859 | A1 | 5/2017 | Lin et al. | |
| 2018/0204889 | A1* | 7/2018 | Yu | G09G 3/3233 |

FOREIGN PATENT DOCUMENTS

| | | | |
|---|---|---|---|
| CN | 105632404 | A | 6/2016 |
| CN | 106597748 | A | 4/2017 |
| CN | 107153304 | A | 9/2017 |
| KR | 20120043301 | A | 5/2012 |

* cited by examiner

PIXEL COMPENSATION CIRCUIT AND DISPLAY DEVICE

TECHNICAL FIELD

The invention relates to the field of display, and particularly to a pixel compensation circuit and a display device.

DESCRIPTION OF RELATED ART

In the field of display devices, OLED display devices have advantages such as wide color gamut, high contrast, energy saving, being foldable, compared with LCD display devices, and thus have strong competitiveness in the new generation display devices. In addition, an AMOLED technology is one of the key development directions of flexible displays. As illustrated in FIG. 1, a basic driving circuit of a conventional AMOLED display device includes a switching thin film transistor T1, a driving thin film transistor T2 and a storage capacitor Cst. A driving current of an organic light-emitting diode OLED is controlled by the driving thin film transistor T1 and the magnitude thereof is that $I_{OLED}=k(V_{gs}-V_{th})^2$, where k is a current amplification factor of the driving thin film transistor T1 and determined by the characteristics of the drive thin-film transistor T1 itself, Vth is a threshold voltage of the driving thin film transistor T1. Since the threshold voltage of the driving film transistor Vth T1 is easy to drift, the driving current of the organic light-emitting diode OLED may be unstable, and the picture quality of panel can be degraded.

SUMMARY

A technical problem primarily to be solved by the invention is to provide a pixel compensation circuit and a display device, so as to avoid the unstable current of an organic light-emitting diode caused by the threshold voltage drift and thereby improve image quality of panel.

In order to solve the above technical problem, a technical solution proposed by the invention is to provide a pixel compensation circuit including:

a first controllable switch, the first controllable switch including a control terminal, a first terminal and a second terminal, the control terminal of the first controllable switch being connected to a first light-emitting control terminal, the first terminal of the first controllable switch being connected to a first voltage terminal;

a second controllable switch, the second controllable switch including a control terminal, a first terminal and a second terminal, the control terminal of the second controllable switch being connected to a second light-emitting control terminal, the first terminal of the second controllable switch being connected to the first terminal of the first controllable switch;

a third controllable switch, the third controllable switch including a control terminal, a first terminal and a second terminal, the control terminal of the third controllable switch being connected to receive a first control signal, the first terminal of the third controllable switch being connected to the second terminal of the first controllable switch;

a driving switch, the driving switch including a control terminal, a first terminal and a second terminal, the first terminal of the driving switch being connected to the second terminal of the third controllable switch;

an organic light-emitting diode, the organic light-emitting diode including an anode and a cathode, the anode of the organic light-emitting diode being connected to the second terminal of the driving switch, the cathode of the organic light-emitting diode being connected to a second voltage terminal;

a fourth controllable switch, the fourth controllable switch including a control terminal, a first terminal and a second terminal, the control terminal of the fourth controllable switch being connected to receive a second control signal, the first terminal of the fourth controllable switch being connected to receive a third control signal, the second terminal of the fourth controllable switch being connected to the control terminal of the driving switch;

a first capacitor, the first capacitor including a first terminal and a second terminal, the first terminal of the first capacitor being connected to the control terminal of the driving switch, the second terminal of the first capacitor being connected to the second terminal of the second controllable switch; and a second capacitor, the second capacitor including a first terminal and a second terminal, the first terminal of the second capacitor being connected to the second terminal of the second controllable switch and the second terminal of the first capacitor, the second terminal of the second capacitor being connected to the second terminal of the first controllable switch and the first terminal of the third controllable switch;

wherein the second control signal is a current stage scan signal, the third control signal is a data signal;

wherein the pixel compensation circuit further includes a fifth controllable switch, when the second control signal received by the control terminal of the fourth controllable switch is the current stage scan signal and the third control signal received by the first terminal of the fourth controllable switch is the data signal, a control terminal of the fifth controllable switch is connected to receive a preceding stage scan signal, a first terminal of the fifth controllable switch is connected to receive a reference voltage signal, a second terminal of the fifth controllable switch is connected to the control terminal of the driving switch;

a phase of an output signal of the first light-emitting control terminal and a phase of an output signal of the second light-emitting control terminal are inverted, a phase of the first control signal and a phase of the current stage scan signal are inverted, a voltage on the second voltage terminal is lower than a voltage on the first voltage terminal;

the driving switch and the first through fifth controllable switches all are PMOS transistors, the control terminals, the first terminals and the second terminals of the driving switch and the first through fifth controllable switches respectively are corresponding to gates, sources and drains of the PMOS transistors.

In order to solve the above technical problem, another technical solution proposed by the invention is to provide a pixel compensation circuit including:

a first controllable switch, wherein the first controllable switch includes a control terminal, a first terminal and a second terminal, the control terminal of the first controllable switch is connected to a first light-emitting control terminal, the first terminal of the first controllable switch is connected to a first voltage terminal;

a second controllable switch, wherein the second controllable switch includes a control terminal, a first terminal and a second terminal, the control terminal of the second controllable switch is connected to a second light-emitting control terminal, the first terminal of the second controllable switch is connected to the first terminal of the first controllable switch;

a third controllable switch, wherein the third controllable switch includes a control terminal, a first terminal and a second terminal, the control terminal of the third controllable switch is connected to receive a first control signal, the first terminal of the third controllable switch is connected to the second terminal of the first controllable switch;

a driving switch, wherein the driving switch includes a control terminal, a first terminal and a second terminal, the first terminal of the driving switch is connected to the second terminal of the third controllable switch;

an organic light-emitting diode, wherein the organic light-emitting diode includes an anode and a cathode, the anode of the organic light-emitting diode is connected to the second terminal of the driving switch, the cathode of the organic light-emitting diode is connected to a second voltage terminal;

a fourth controllable switch, wherein the fourth controllable switch includes a control terminal, a first terminal and a second terminal, the control terminal of the fourth controllable switch is connected to receive a second control signal, the first terminal of the fourth controllable switch is connected to receive a third control signal, the second terminal of the fourth controllable switch is connected to the control terminal of the driving switch;

a first capacitor, wherein the first capacitor includes a first terminal and a second terminal, the first terminal of the first capacitor is connected to the control terminal of the driving switch, the second terminal of the first capacitor is connected to the second terminal of the second controllable switch; and a second capacitor, wherein the second capacitor includes a first terminal and a second terminal, the first terminal of the second capacitor is connected to the second terminal of the second controllable switch and the second terminal of the first capacitor, the second terminal of the second capacitor is connected to the second terminal of the first controllable switch and the first terminal of the third controllable switch; wherein the second control signal is a current stage scan signal, and the third control signal is a data signal; wherein the pixel compensation circuit further comprises a fifth controllable switch; when the second control signal received by the control terminal of the fourth controllable switch is the current stage scan signal and the third control signal received by the first terminal of the fourth controllable switch is the data signal, a control terminal of the fifth controllable switch is connected to receive a preceding stage scan signal, a first terminal of the fifth controllable switch is connected to receive a reference voltage signal, a second terminal of the fifth controllable switch is connected to the control terminal of the driving switch.

In order to solve the above technical problem, still another technical solution proposed by the invention is to provide a display device. The display device includes a pixel compensation circuit. The pixel compensation circuit includes:

a first controllable switch, wherein the first controllable switch includes a control terminal, a first terminal and a second terminal, the control terminal of the first controllable switch is connected to a first light-emitting control terminal, the first terminal of the first controllable switch is connected to a first voltage terminal;

a second controllable switch, wherein the second controllable switch includes a control terminal, a first terminal and a second terminal, the control terminal of the second controllable switch is connected to a second light-emitting control terminal, the first terminal of the second controllable switch is connected to the first terminal of the first controllable switch;

a third controllable switch, wherein the third controllable switch includes a control terminal, a first terminal and a second terminal, the control terminal of the third controllable switch is connected to receive a first control signal, the first terminal of the third controllable switch is connected to the second terminal of the first controllable switch;

a driving switch, wherein the driving switch includes a control terminal, a first terminal and a second terminal, the first terminal of the driving switch is connected to the second terminal of the third controllable switch;

an organic light-emitting diode, wherein the organic light-emitting diode includes an anode and a cathode, the anode of the organic light-emitting diode is connected to the second terminal of the driving switch, the cathode of the organic light-emitting diode is connected to a second voltage terminal;

a fourth controllable switch, wherein the fourth controllable switch includes a control terminal, a first terminal and a second terminal, the control terminal of the fourth controllable switch is connected to receive a second control signal, the first terminal of the fourth controllable switch is connected to receive a third control signal, the second terminal of the fourth controllable switch is connected to the control terminal of the driving switch;

a first capacitor, wherein the first capacitor includes a first terminal and a second terminal, the first terminal of the first capacitor is connected to the control terminal of the driving switch, the second terminal of the first capacitor is connected to the second terminal of the second controllable switch; and a second capacitor, wherein the second capacitor includes a first terminal and a second terminal, the first terminal of the second capacitor is connected to the second terminal of the second controllable switch and the second terminal of the first capacitor, the second terminal of the second capacitor is connected to the second terminal of the first controllable switch and the first terminal of the third controllable switch; wherein the second control signal is a current stage scan signal, the third control signal is a data signal; wherein the pixel compensation circuit further comprises a fifth controllable switch; when the second control signal received by the control terminal of the fourth controllable switch is the current stage scan signal and the third control signal received by the first terminal of the fourth controllable switch is the data signal, a control terminal of the fifth controllable switch is connected to receive a preceding stage scan signal, a first terminal of the fifth controllable switch is connected to receive a reference voltage signal, a second terminal of the fifth controllable switch is connected to the control terminal of the driving switch.

Efficacy can be achieved by the invention is that different from the prior art, the pixel compensation circuit and the display device of the invention use multiple controllable switches and two capacitors to cause an electric leakage of the driving switch to thereby realize a threshold voltage compensation for the driving switch, which can avoid the issue of unstable current of the organic light-emitting diode resulting from the threshold voltage drift of the driving switch, and image quality of panel is improved consequently.

DETAILED DESCRIPTION OF EMBODIMENTS

Figure 1:
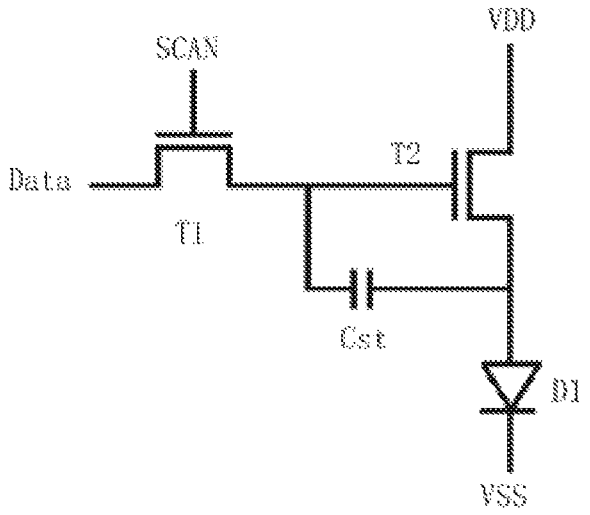
FIG. 1(Prior Art)
FIG. 1 is a schematic circuit diagram of a basic driving circuit of a conventional display device.
Figure 2:
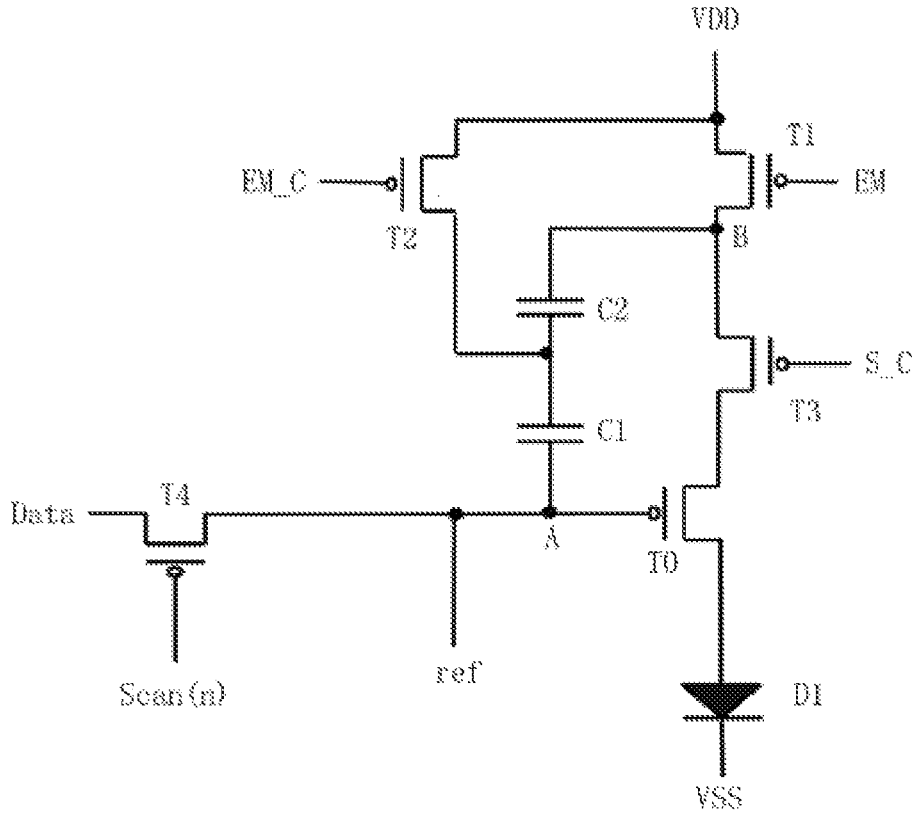
FIG. 2 is a schematic circuit diagram of a first embodiment of a pixel compensation circuit of the invention.

Referring to FIG. 2, it is a schematic circuit diagram of a first embodiment of a pixel compensation circuit of the invention. The pixel compensation circuit includes: a first controllable switch T1, the first controllable switch T1 including a control terminal, a first terminal and a second terminal, the control terminal of the first controllable switch T1 being connected (e.g., only connected by a wire as illustrated in the drawing) to a first light-emitting control terminal EM, the first terminal of the first controllable switch T1 being connected to a first voltage terminal VDD;

a second controllable switch T2, the first controllable switch T2 including a control terminal, a first terminal and a second terminal, the control terminal of the second controllable switch T2 being connected to a second light-emitting control terminal EM_C, the first terminal of the second controllable switch T2 being connected to the first terminal of the first controllable switch T1;

a third controllable switch T3, the third controllable switch T3 including a control terminal, a first terminal and a second terminal, the control terminal of the third controllable switch T3 being connected to receive a first control signal S_C, the first terminal of the third controllable switch T3 being connected to the second terminal of the first controllable switch T1;

a driving switch T0, the driving switch T0 including a control terminal, a first terminal and a second terminal, the first terminal of the driving switch T0 being connected to the second terminal of the third controllable switch T3;

an organic light-emitting diode D1, the organic light-emitting diode D1 including an anode and a cathode, the anode of the organic light-emitting diode D1 being connected to the second terminal of the driving switch T0, the cathode of the organic light-emitting diode D1 being connected to a second voltage terminal VSS;

a fourth controllable switch T4, the fourth controllable switch T4 including a control terminal, a first terminal and a second terminal, the control terminal of the fourth controllable switch T4 being connected to receive a second control signal, the first terminal of the fourth controllable switch T4 being connected to receive a third control signal, and the second terminal of the fourth controllable switch T4 being connected to the control terminal of the driving switch T0;

a first capacitor C1, the first capacitor C1 including a first terminal and a second terminal, the first terminal of the first capacitor C1 being connected to the control terminal of the driving switch T0, and the second terminal of the first capacitor C1 being connected to the second terminal of the second controllable switch T2; and a second capacitor C2, the second capacitor C2 including a first terminal and a second terminal, the first terminal of the second capacitor C2 being connected to the second terminal of the second controllable switch T2 and the second terminal of the first capacitor C1, the second terminal of the second capacitor C2 being connected to the second terminal of the first controllable switch T1 and the first terminal of the third controllable switch T3.

In the illustrated embodiment, the second control signal received by the control terminal of the fourth controllable switch T4 is a current stage scan signal scan(n), the third control signal received by the first terminal of the fourth controllable switch T4 is a data signal Data, and a fourth control signal received by the control terminal of the driving switch T0 is a reference voltage signal ref.

A phase of an output signal of the first light-emitting control terminal EM and a phase of an output signal of the second light-emitting control terminal EM_C are inverted, a phase of the first control signal S_C and a phase of the current stage scan signal scan(n) are inverted, a voltage on the second voltage terminal VSS is lower than a voltage on the first voltage terminal VDD.

The driving switch T0 and the first through fourth controllable switches T1-T4 all are PMOS transistors. The control terminals, the first terminals and the second terminals of the driving switch T0 and the first through fourth controllable switches T1-T4 respectively are corresponding to gates, sources and drains of the PMOS transistors. In other embodiment, the first through fourth controllable switches may be other type switches, as long as the purpose of the invention can be realized.

Figure 8:
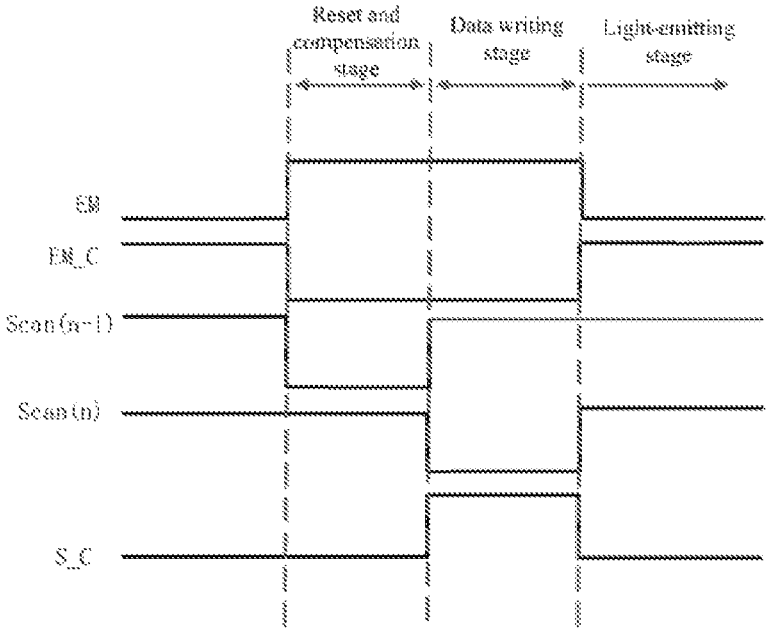
FIG. 8 is a schematic timing waveform diagram.
Figure 9:
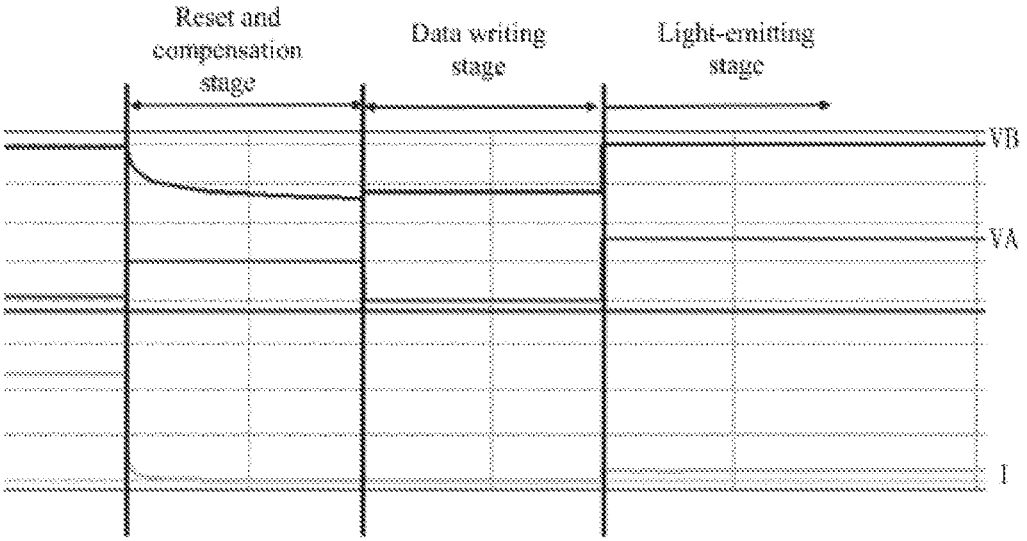
FIG. 9 is a schematic simulation waveform diagram.

Referring to FIG. 2, FIG. 8 and FIG. 9, a working principle of the pixel compensation circuit will be described as follows.

In a reset and compensation stage, the first controllable switch T1 is turned off, the second controllable switch T2 is turned on, a voltage signal outputted by the first voltage terminal VDD is written to a common node between the first capacitor C1 and the second capacitor C2, the node B is stored with a high voltage outputted by the first voltage terminal VDD before the first controllable switch T1 is turned off, the voltage on the node A is the reference voltage signal and stored in the first capacitor C1, and VDD−Vref>Vth, where VDD is the voltage outputted by the first voltage terminal VDD, Vref is the reference voltage signal, and Vth is a threshold voltage of the driving switch and further is an absolute value; at this time, the driving switch T0 and the third controllable switch T3 both are turned on, and thus the threshold voltage Vth is compensated by an electric leakage of the driving switch T0, the voltage on the node B is Vref−Vth.

In a data writing stage, the reference voltage signal ref is cut off, the fourth controllable switch T4 is turned on, the data signal Data is written to the control terminal of the driving switch T0 and stored in the first capacitor C1, at this time the third controllable switch T3 is turned off, and thus the voltage on the node B still is Vref−Vth.

In a light-emitting stage, the first controllable switch T1 and the third controllable switch T3 both are turned on, the voltage on the node B jumps to the voltage outputted by the first voltage terminal VDD, the voltage on the node A is coupled to be Vdata−Vref+VDD+Vth by the data signal Data, a gate-source voltage Vgs of the driving switch T0 is changed to be Vdata−Vref, when Vref−Vdata>Vth, the organic light-emitting diode D1 starts to emit light, an anode current of the organic light-emitting diode D1 is that: $I=k(Vdata-Vref)^2$, where k is a coefficient and constant.

Figure 3:
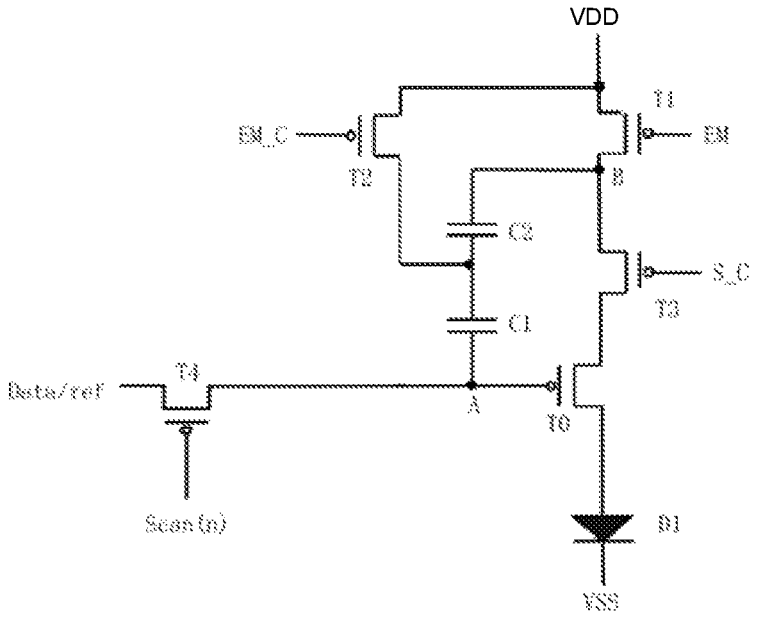
FIG. 3 is a schematic circuit diagram of a second embodiment of the pixel compensation circuit of the invention.

Referring to FIG. 3, it is a schematic circuit diagram of a second embodiment of the pixel compensation circuit of the invention. Difference of the second embodiment of the pixel compensation circuit from the above described first embodiment are that: the control terminal of the driving switch T0 does not receive the fourth control signal, and the third control signal received by the first terminal of the fourth controllable switch T4 is a data signal or a reference voltage signal, that is, the data signal Data outputs the data signal or the reference voltage signal via a signal jump.

A working principle of the pixel compensation circuit will be described as follows.

In a reset and compensation stage, the first controllable switch T1 is turned off, the second controllable switch T2 is turned on, the voltage signal outputted by the first voltage terminal VDD is written to the common node between the first capacitor C1 and the second capacitor C2, the node B is stored with a high voltage outputted by the first voltage terminal VDD before the first controllable switch T1 is turned off, the fourth controllable switch T4 is turned on, the data signal Data outputs the reference voltage signal to make the voltage on the node A be the reference voltage signal ref and stored in the first capacitor C1, VDD−Vref>Vth, where VDD is the voltage outputted by the first voltage terminal VDD, Vref is the reference voltage signal, Vth is a threshold voltage of the driving switch and further is an absolute value, at this moment, the driving switch T0 and the third controllable switch T3 both are turned on, the threshold voltage Vth is compensated by an electric leakage of the driving switch T0, the voltage on the node B is Vref−Vth.

In a data writing stage, the fourth controllable switch T4 is kept at turned-on state, the data signal Data is changed from the reference voltage signal ref to the data signal Data and written into the control terminal of the driving switch T0 and further stored in the first capacitor C1, at this time the third controllable switch T3 is turned off, and thus the voltage on the node B still is Vref−Vth.

In a light-emitting stage, the first controllable switch T1 and the third controllable switch T3 both are turned on, the voltage on the node B jumps to the voltage outputted by the first voltage terminal VDD, the voltage on the node A is coupled to be Vdata−Vref+VDD+Vth by the data signal Data, the gate-source voltage Vgs of the driving switch T0 is changed to be Vdata−Vref, when Vref−Vdata>Vth, the organic light-emitting diode D1 starts to emit light, an anode current of the organic light-emitting diode D1 is that: $I=k(Vdata-Vref)^2$, where k is a coefficient and constant.

Figure 4:
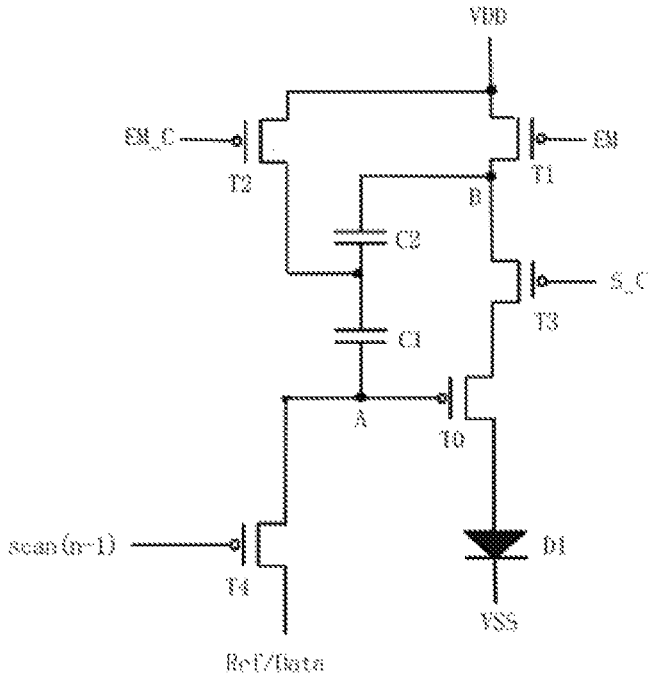
FIG. 4 is a schematic circuit diagram of a third embodiment of the pixel compensation circuit of the invention.

Referring to FIG. 4, it is a schematic circuit diagram of a third embodiment of the pixel compensation circuit of the invention. Difference of the third embodiment of the pixel compensation circuit from the above described second embodiment are that: the second control signal received by the control terminal of the fourth controllable switch T4 is a preceding stage scan signal scan(n−1), the third control signal received by the first terminal of the fourth controllable switch T4 is a reference voltage signal or a data signal, that is, the data signal Data outputs the data signal or the reference voltage signal by a signal jump.

In the third embodiment of the pixel compensation circuit, except the fourth controllable switch T4 is turned on or turned off under the control of the preceding stage scan signal scan(n−1), the working principle thereof is the same as the working principle of the above described second embodiment, and thus will not be repeated herein.

Figure 5:
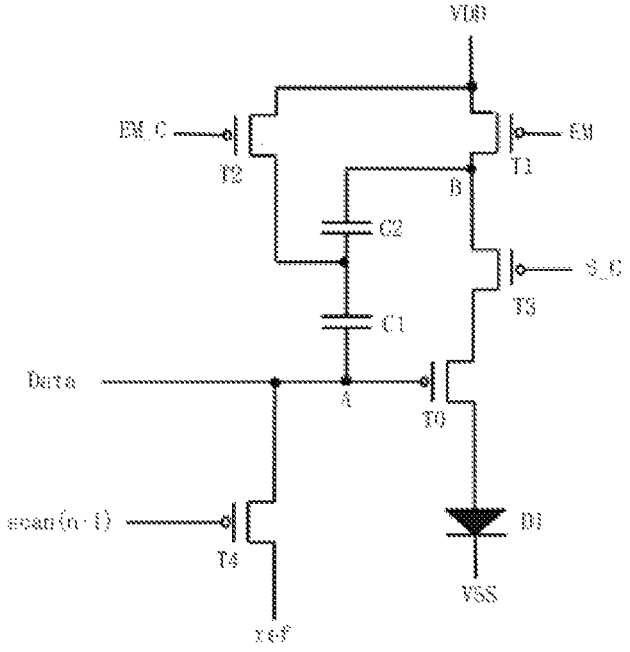
FIG. 5 is a schematic circuit diagram of a fourth embodiment of the pixel compensation circuit of the invention.

Referring to FIG. 5, it is a schematic circuit diagram of a fourth embodiment of the pixel compensation circuit of the invention. Differences of the fourth embodiment of the pixel compensation circuit from the above described first embodiment are that: the second control signal received by the control terminal of the fourth controllable switch T4 is a preceding stage scan signal scan(n−1), the third control signal received by the first terminal of the fourth controllable switch T4 is a reference voltage signal ref, the fourth control signal received by the control terminal of the driving switch T0 is a data signal Data.

Referring to FIG. 5, FIG. 8 and FIG. 9, a working principle of the pixel compensation circuit will be described as follows.

In a reset and compensation stage, the first controllable switch T1 is turned off, the second controllable switch T2 is turned on, a voltage signal outputted by the first voltage terminal VDD is written to the common node between the first capacitor C1 and the second capacitor C2, the node B stores the high voltage outputted by the first voltage terminal VDD before the first controllable switch T1 is turned off, the fourth controllable switch T4 is turned on, the voltage on the node A is set to be the reference voltage signal ref and stored in the first capacitor C1, VDD−Vref>Vth, where VDD is the voltage outputted by the first voltage terminal VDD, Vref is the reference voltage signal, and Vth is a threshold voltage of the driving switch T0 and further is an absolute value, at this moment, the driving switch T0 and the third controllable switch T3 both are turned on, and thus the threshold voltage Vth is compensated by an electric leakage of the driving switch T0, the voltage on the node B is Vref−Vth.

In a data writing stage, the fourth controllable switch T4 is turned off, the reference voltage signal ref is cut off, the data signal Data is written to the control terminal of the driving switch T0 and stored in the first capacitor C1, at this time the third controllable switch T3 is turned off, and thus the voltage on the node B still is Vref−Vth.

In a light-emitting stage, the first controllable switch T1 and the third controllable switch T3 both are turned on, the voltage on the node B jumps to the voltage outputted by the first voltage terminal VDD, the voltage on the node A is coupled to be Vdata−Vref+VDD+Vth by the data signal, the gate-source voltage Vgs of the driving switch T0 is changed to be Vdata−Vref, when Vref−Vdata>Vth, the organic light-emitting diode D1 starts to emit light, the anode current of the organic light-emitting diode D1 is that: $I=k(Vdata-Vref)^2$, where k is a coefficient and constant.

Figure 6:
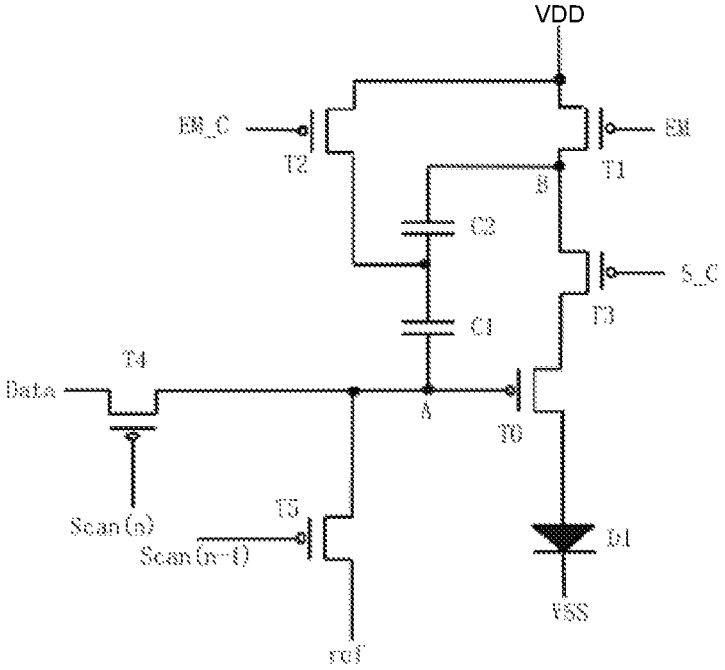
FIG. 6 is a schematic circuit diagram of a fifth embodiment of the pixel compensation circuit of the invention.

Referring to FIG. 6, it is a schematic circuit diagram of a fifth embodiment of the pixel compensation circuit of the invention. Differences of the fifth embodiment of the pixel compensation circuit from the above described first embodiment are that: the pixel compensation circuit further includes a fifth controllable switch T5, a control terminal of the fifth controllable switch T5 is connected to receive a preceding stage scan signal scan(n−1), a first terminal of the fifth controllable switch T5 is connected to receive a reference voltage signal ref, and a second terminal of the fifth controllable switch T5 is connected to the control terminal of the driving switch T0.

The fifth controllable switch T5 is a PMOS transistor, the control terminal, the first terminal and the second terminal of the fifth controllable switch T5 respectively are corresponding to a gate, a source and a drain of the PMOS transistor.

Referring to FIG. 6, FIG. 8 and FIG. 9, a working principle of the pixel compensation circuit will be described as follows.

In a reset and compensation stage, the first controllable switch T1 is turned off, the second controllable switch T2 is turned on, the voltage signal outputted by the first voltage terminal VDD is written to the common node between the first capacitor C1 and the second capacitor C2, the node B is stored with the high voltage outputted by the first voltage terminal VDD before the first controllable switch T1 is turned off, the fifth controllable switch T5 is turned on, the voltage on the node A is set to be the reference voltage signal ref and stored into the first capacitor C1, VDD−Vref>Vth, where VDD is the voltage outputted by the first voltage terminal VDD, Vref is the reference voltage signal, and Vth is a threshold voltage of the driving switch T0 and further is an absolute value, at this time, the driving switch T0 and the third controllable switch T3 both are turned on, the threshold voltage Vth is compensated by an electric leakage of the driving switch T0, the voltage on the node B is Vref−Vth.

In a data writing stage, the fifth controllable switch T5 is turned off, the fourth controllable switch T4 is turned on, the data signal Data is written to the control terminal of the driving switch T0 and stored in the first capacitor C1, at this moment the third controllable switch T3 is turned off, and thus the voltage on the node B still is Vref−Vth.

In a light-emitting stage, the first controllable switch T1 and the third controllable switch T3 both are turned on, the voltage on the node B jumps to the voltage outputted by the first voltage terminal VDD, the voltage on the node A is coupled to be Vdata−Vref+VDD+Vth by the data signal, the gate-source voltage Vgs of the driving switch T0 is changed to be Vdata−Vref, when Vref−Vdata>Vth, the organic light-emitting diode D1 starts to emit light, an anode current of the organic light-emitting diode D1 is that: $I=k(Vdata-Vref)^2$, where k is a coefficient and constant.

Figure 7:
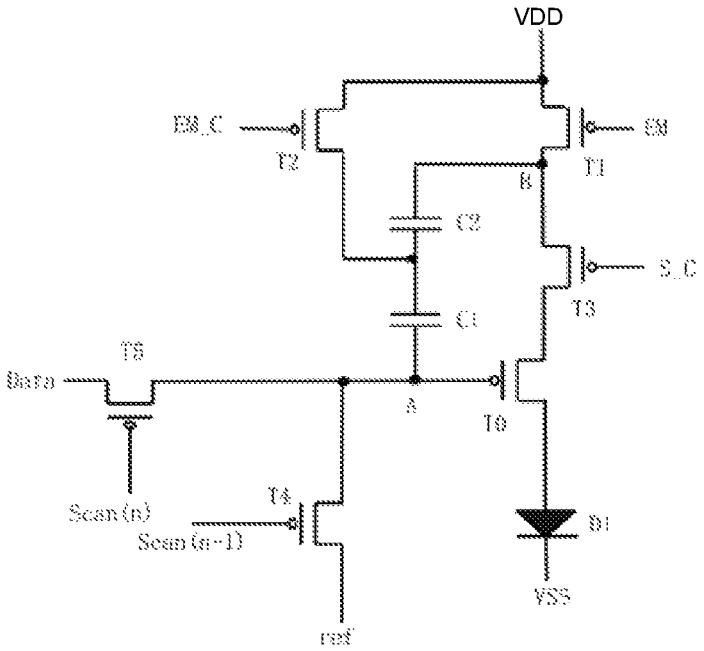
FIG. 7 is a schematic circuit diagram of a sixth embodiment of the pixel compensation circuit of the invention.

Referring to FIG. 7, it is a schematic circuit diagram of a sixth embodiment of the pixel compensation circuit of the invention. Differences of the sixth embodiment of the pixel compensation circuit from the above described fourth embodiment are that: the pixel compensation circuit further includes a fifth controllable switch T5, a control terminal of the fifth controllable switch T5 is connected to receive a current stage scan signal scan(n), a first terminal of the fifth controllable switch T5 is connected to receive a data signal Data, and a second terminal of the fifth controllable switch T5 is connected to the control terminal of the driving switch T0.

The fifth controllable switch T5 is a PMOS transistor, the control terminal, the first terminal and the second terminal of the fifth controllable switch T5 respectively are corresponding to a gate, a source and a drain of the PMOS transistor.

Referring to FIG. 7 through FIG. 9, a working principle of the pixel compensation circuit will be described as follows.

In a reset and compensation stage, the first controllable switch T1 is turned off, the second controllable switch T2 is turned on, the voltage signal outputted by the first voltage terminal VDD is written to the common node between the first capacitor C1 and the second capacitor C2, the node B is stored with the high voltage outputted by the first voltage terminal VDD before the first controllable switch T1 is turned off, the fourth controllable switch T4 is turned on, the voltage on the node A is set to be the reference voltage signal ref and stored in the first capacitor C1, and VDD−Vref>Vth, where VDD is the voltage outputted by the first voltage terminal VDD, Vref is the reference voltage signal, Vth is a threshold voltage of the driving switch T0 and further is an absolute value, at this moment, the driving switch T0 and the third controllable switch T3 both are turned on, the threshold voltage Vth is compensated by an electric leakage of the driving switch T0, the voltage on the node B is Vref−Vth.

In a data writing stage, the fourth controllable switch T4 is turned off, the fifth controllable switch T5 is turned on, the data signal Data is written to the control terminal of the driving switch T0 and stored in the first capacitor C1, at this moment the third controllable switch T3 is turned off, and thus the voltage on the node B still is Vref−Vth.

In a light-emitting stage, the first controllable switch T1 and the third controllable switch T3 both are turned on, the voltage on the node B jumps to the voltage outputted by the first voltage terminal VDD, the voltage on the node A is coupled to be Vdata−Vref+VDD+Vth by the data signal, the gate-source voltage Vgs of the driving switch T0 is changed to be Vdata−Vref, when Vref−Vdata>Vth, the organic light-emitting diode D1 starts to emit light, an anode current of the organic light-emitting diode D1 is that: $I=k(Vdata-Vref)^2$, where k is a coefficient and constant.

Figure 10:
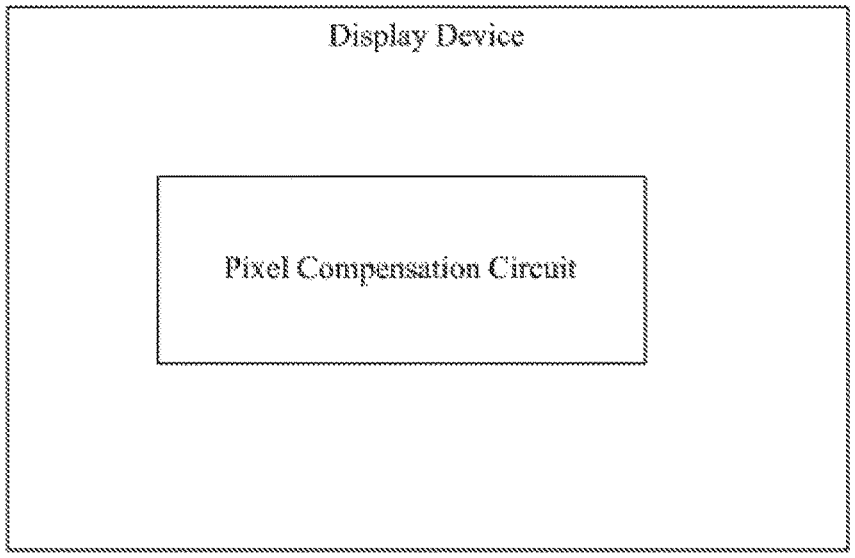
FIG. 10 is a schematic structural view of a display device of the invention.

Referring to FIG. 10, it is a schematic structural view of a display device of the invention. The display device includes any one of the above described embodiments of the pixel compensation circuit, other components and functions of the display device are the same as the components and functions of conventional display devices and thus will not be described herein.

The pixel compensation circuit and the display device use multiple (i.e., more than one) controllable switches and two capacitors to cause an electric leakage of the driving switch to thereby realize the threshold voltage compensation for the driving switch, which can avoid the issue of unstable current of the organic light-emitting diode caused by the threshold voltage drift of the driving switch, and image quality of panel is improved consequently.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel compensation circuit, wherein the pixel compensation circuit comprises:

a first controllable switch, the first controllable switch comprising a control terminal, a first terminal and a second terminal, the control terminal of the first controllable switch being connected to a first light-emitting control terminal, the first terminal of the first controllable switch being connected to a first voltage terminal;

a second controllable switch, the second controllable switch comprising a control terminal, a first terminal and a second terminal, the control terminal of the second controllable switch being connected to a second light-emitting control terminal, the first terminal of the second controllable switch being connected to the first terminal of the first controllable switch;

a third controllable switch, the third controllable switch comprising a control terminal, a first terminal and a second terminal, the control terminal of the third controllable switch being connected to receive a first control signal, the first terminal of the third controllable switch being connected to the second terminal of the first controllable switch;

a driving switch, the driving switch comprising a control terminal, a first terminal and a second terminal, the first terminal of the driving switch being connected to the second terminal of the third controllable switch;

an organic light-emitting diode, the organic light-emitting diode comprising an anode and a cathode, the anode of the organic light-emitting diode being connected to the second terminal of the driving switch, the cathode of the organic light-emitting diode being connected to a second voltage terminal;

a fourth controllable switch, the fourth controllable switch comprising a control terminal, a first terminal and a second terminal, the control terminal of the fourth controllable switch being connected to receive a second control signal, the first terminal of the fourth controllable switch being connected to receive a third control signal, the second terminal of the fourth controllable switch being connected to the control terminal of the driving switch;

a first capacitor, the first capacitor comprising a first terminal and a second terminal, the first terminal of the first capacitor being connected to the control terminal of the driving switch, the second terminal of the first capacitor being connected to the second terminal of the second controllable switch;

a second capacitor, the second capacitor comprising a first terminal and a second terminal, the first terminal of the second capacitor being connected to the second terminal of the second controllable switch and the second terminal of the first capacitor, the second terminal of the second capacitor being connected to the second terminal of the first controllable switch and the first terminal of the third controllable switch;

wherein the second control signal is a current stage scan signal, the third control signal is a data signal;

wherein the pixel compensation circuit further comprises a fifth controllable switch, when the second control signal received by the control terminal of the fourth controllable switch is the current stage scan signal and the third control signal received by the first terminal of the fourth controllable switch is the data signal, a control terminal of the fifth controllable switch is connected to receive a preceding stage scan signal, a first terminal of the fifth controllable switch is connected to receive a reference voltage signal, a second terminal of the fifth controllable switch is connected to the control terminal of the driving switch;

a phase of an output signal of the first light-emitting control terminal and a phase of an output signal of the second light-emitting control terminal are inverted, a phase of the first control signal and a phase of the current stage scan signal are inverted, a voltage on the second voltage terminal is lower than a voltage on the first voltage terminal;

the driving switch and the first through fifth controllable switches all are PMOS transistors, the control terminals, the first terminals and the second terminals of the driving switch and the first through fifth controllable switches respectively are corresponding to gates, sources and drains of the PMOS transistors.

2. A pixel compensation circuit, wherein the pixel compensation circuit comprises:

a first controllable switch, wherein the first controllable switch comprises a control terminal, a first terminal and a second terminal, the control terminal of the first controllable switch is connected to a first light-emitting control terminal, the first terminal of the first controllable switch is connected to a first voltage terminal;

a second controllable switch, wherein the second controllable switch comprises a control terminal, a first terminal and a second terminal, the control terminal of the second controllable switch is connected to a second light-emitting control terminal, the first terminal of the second controllable switch is connected to the first terminal of the first controllable switch;

a third controllable switch, wherein the third controllable switch comprises a control terminal, a first terminal and a second terminal, the control terminal of the third controllable switch is connected to receive a first control signal, the first terminal of the third controllable switch is connected to the second terminal of the first controllable switch;

a driving switch, wherein the driving switch comprises a control terminal, a first terminal and a second terminal, the first terminal of the driving switch is connected to the second terminal of the third controllable switch;

an organic light-emitting diode, wherein the organic light-emitting diode comprises an anode and a cathode, the anode of the organic light-emitting diode is connected to the second terminal of the driving switch, the cathode of the organic light-emitting diode is connected to a second voltage terminal;

a fourth controllable switch, wherein the fourth controllable switch comprises a control terminal, a first terminal and a second terminal, the control terminal of the fourth controllable switch is connected to receive a second control signal, the first terminal of the fourth controllable switch is connected to receive a third control signal, the second terminal of the fourth controllable switch is connected to the control terminal of the driving switch;

a first capacitor, wherein the first capacitor comprises a first terminal and a second terminal, the first terminal of the first capacitor is connected to the control terminal of the driving switch, the second terminal of the first capacitor is connected to the second terminal of the second controllable switch;

a second capacitor, wherein the second capacitor comprises a first terminal and a second terminal, the first terminal of the second capacitor is connected to the second terminal of the second controllable switch and the second terminal of the first capacitor, the second terminal of the second capacitor is connected to the second terminal of the first controllable switch and the first terminal of the third controllable switch;

wherein the second control signal is a current stage scan signal, and the third control signal is a data signal;

wherein the pixel compensation circuit further comprises a fifth controllable switch; when the second control signal received by the control terminal of the fourth controllable switch is the current stage scan signal and the third control signal received by the first terminal of the fourth controllable switch is the data signal, a control terminal of the fifth controllable switch is connected to receive a preceding stage scan signal, a first terminal of the fifth controllable switch is connected to receive a reference voltage signal, a second terminal of the fifth controllable switch is connected to the control terminal of the driving switch.

3. The pixel compensation circuit as claimed in claim 2, wherein a phase of an output signal of the first light-emitting control terminal and a phase of an output signal of the second light-emitting control terminal are inverted, a phase of the first control signal and a phase of the current stage scan signal are inverted, a voltage on the second voltage terminal is lower than a voltage on the first voltage terminal.

4. The pixel compensation circuit as claimed in claim 2, wherein the driving switch and the first through fifth controllable switches all are PMOS transistors, the control terminals, the first terminals and the second terminals of the driving switch and the first through fifth controllable switches respectively are corresponding to gates, sources and drains of the PMOS transistors.

5. A display device, wherein the display device comprises pixel compensation circuit, the pixel compensation circuit comprising:

a first controllable switch, wherein the first controllable switch comprises a control terminal, a first terminal and a second terminal, the control terminal of the first controllable switch is connected to a first light-emitting control terminal, the first terminal of the first controllable switch is connected to a first voltage terminal;

a second controllable switch, wherein the second controllable switch comprises a control terminal, a first terminal and a second terminal, the control terminal of the second controllable switch is connected to a second light-emitting control terminal, the first terminal of the second controllable switch is connected to the first terminal of the first controllable switch;

a third controllable switch, wherein the third controllable switch comprises a control terminal, a first terminal and a second terminal, the control terminal of the third controllable switch is connected to receive a first control signal, the first terminal of the third controllable switch is connected to the second terminal of the first controllable switch;

a driving switch, wherein the driving switch comprises a control terminal, a first terminal and a second terminal, the first terminal of the driving switch is connected to the second terminal of the third controllable switch;

an organic light-emitting diode, wherein the organic light-emitting diode comprises an anode and a cathode, the anode of the organic light-emitting diode is connected to the second terminal of the driving switch, the cathode of the organic light-emitting diode is connected to a second voltage terminal;

a fourth controllable switch, wherein the fourth controllable switch comprises a control terminal, a first terminal and a second terminal, the control terminal of the fourth controllable switch is connected to receive a second control signal, the first terminal of the fourth controllable switch is connected to receive a third control signal, the second terminal of the fourth controllable switch is connected to the control terminal of the driving switch;

a first capacitor, wherein the first capacitor comprises a first terminal and a second terminal, the first terminal of the first capacitor is connected to the control terminal of the driving switch, the second terminal of the first capacitor is connected to the second terminal of the second controllable switch;

a second capacitor, wherein the second capacitor comprises a first terminal and a second terminal, the first terminal of the second capacitor is connected to the second terminal of the second controllable switch and the second terminal of the first capacitor, the second terminal of the second capacitor is connected to the second terminal of the first controllable switch and the first terminal of the third controllable switch;

wherein the second control signal is a current stage scan signal, the third control signal is a data signal;

wherein the pixel compensation circuit further comprises a fifth controllable switch; when the second control signal received by the control terminal of the fourth controllable switch is the current stage scan signal and the third control signal received by the first terminal of the fourth controllable switch is the data signal, a control terminal of the fifth controllable switch is connected to receive a preceding stage scan signal, a first terminal of the fifth controllable switch is connected to receive a reference voltage signal, a second terminal of the fifth controllable switch is connected to the control terminal of the driving switch.

6. The display device as claimed in claim 5, wherein a phase of an output signal of the first light-emitting control terminal and a phase of an output signal of the second light-emitting control terminal are inverted, a phase of the first control signal and a phase of the current stage scan signal are inverted, a voltage on the second voltage terminal is lower than a voltage on the first voltage terminal.

7. The display device as claimed in claim 5, wherein the driving switch and the first through fifth controllable switches all are PMOS transistors, the control terminals, the first terminals and the second terminals of the driving switch and the first through fifth controllable switches respectively are corresponding to gates, sources and drains of the PMOS transistors.

* * * * *